US005841229A

United States Patent [19]

Borowiec et al.

[11] Patent Number: 5,841,229

[45] Date of Patent: Nov. 24, 1998

[54] AMALGAM SUPPORT ARRANGEMENT FOR AN ELECTRODELESS DISCHARGE LAMP

[75] Inventors: Joseph Christopher Borowiec, Schenectady, N.Y.; Martin Geoffrey Scott; Shaun Adrian Malin, both of Leicester, United Kingdom; Erno Soos, Nagykanizsa, Hungary

[73] Assignee: General Electric Company, Schenectady, N.Y.

[21] Appl. No.: 905,301

[22] Filed: Aug. 1, 1997

Related U.S. Application Data

[63] Continuation of Ser. No. 547,076, Oct. 23, 1995, abandoned.

[51] Int. Cl.[6] ..... H01J 61/28

[52] U.S. Cl. ..... 313/490; 313/550; 313/161; 315/248

[58] Field of Search ..... 313/160, 161, 313/490, 491, 493, 549, 634, 572, 565, 550, 552; 445/26, 41; 362/264; 315/248, 244

[56] References Cited

U.S. PATENT DOCUMENTS

| | | | |
|---|---|---|---|
| 4,262,231 | 4/1981 | Anderson et al. | 313/490 |
| 4,437,041 | 3/1984 | Roberts | 315/248 |
| 4,622,495 | 11/1986 | Smeelen | 315/248 |
| 5,213,537 | 5/1993 | Roberts et al. | 445/53 |
| 5,412,288 | 5/1995 | Borowiec et al. | 315/248 |
| 5,412,289 | 5/1995 | Thomas et al. | 315/248 |
| 5,434,482 | 7/1995 | Borowiec et al. | 315/248 |
| 5,559,392 | 9/1996 | Cocoma et al. | 313/490 |

OTHER PUBLICATIONS

"Method and Apparatus for Securing an Amalgam at the Apex of an Electrodeless Fluorescent Lamp", Wilson et al., Serial No. 08/194,549 (GE docket RD–23,023), filed Feb. 10, 1994.

"Method and Apparatus for Securing an Amalgam of the Apex of an Electrodeless Fluorescent Lamp", Cocoma et al., Serial No. 08/258,879 (GE docket RD–23,570), filed Jun. 13, 1994.

"Integrated Starting and Running Amalgam Assembly for an Electrodeless Fluorescent Lamp", Borowiec et al., Serial No. 08/316,989 (GE docket RD–23,931), filed Oct. 3, 1994.

*Primary Examiner*—Sandra L. O'Shea
*Assistant Examiner*—Michael Day
*Attorney, Agent, or Firm*—Jill M. Breedlove; Douglas E. Stoner

[57] ABSTRACT

At least one amalgam, which is disposed within the lamp envelope of an electrodeless fluorescent lamp to control mercury vapor pressure, is mechanically supported by an amalgam support arrangement in a manner non-invasive to the lamp envelope. The amalgam support arrangement supports one or more amalgams in a "flag" configuration and includes a support member, one end of which is configured for friction-fitting within the exhaust tube opening. The flag may be configured as a wire mesh or spiral-shaped wire, for example. Exemplary configurations for this end of the support member include a U-shape, spiral, zig-zag, or tubular configuration.

14 Claims, 5 Drawing Sheets

AMALGAM SUPPORT ARRANGEMENT FOR AN ELECTRODELESS DISCHARGE LAMP

This application is a Continuation of application Ser. No. 08/547,076 filed Oct. 23, 1995, now abandoned.

FIELD OF THE INVENTION

The present invention relates generally to electrodeless discharge lamps and, more particularly, to an amalgam support arrangement configured for optimally controlling mercury vapor pressure in an electrodeless fluorescent discharge lamp.

BACKGROUND OF THE INVENTION

The optimum mercury vapor pressure for production of 2537 Å radiation to excite a phosphor coating in a fluorescent lamp is approximately six millitorr, corresponding to a mercury reservoir temperature of approximately 40° C. Conventional tubular fluorescent lamps operate at a power density (typically measured as power input per unit of external area) and in a fixture configuration to ensure operation of the lamp at or about a mercury vapor pressure of six millitorr (typically in a range from approximately four to seven millitorr); that is, the lamp and fixture are designed such that the coolest location, i.e., cold spot, in the fluorescent lamp is approximately 40° C. Compact fluorescent lamps, however, including electrodeless solenoidal electric field (SEF) fluorescent discharge lamps, operate at higher power densities with the cold spot temperature typically exceeding 50° C. As a result, the mercury vapor pressure is higher than the optimum four to seven millitorr range, and the luminous output of the lamp is decreased.

One approach to controlling the mercury vapor pressure in an SEF lamp is to use an alloy capable of absorbing/releasing mercury from/into its gaseous phase in varying amounts, depending upon temperature. Alloys capable of forming amalgams with mercury have been found to be particularly useful. The mercury vapor pressure of such an amalgam at a given temperature is lower than the mercury vapor pressure of pure liquid mercury.

An example of an electrodeless fluorescent lamp which utilizes an amalgam to control mercury vapor pressure is found in Smeelen U.S. Pat. No. 4,622,495, issued Nov. 11, 1986. Smeelen describes a first amalgam disposed on the inner wall portion of the envelope cavity through which the inductance coil portion of the RF circuit extends, this first amalgam being secured to the lamp envelope in a metal-to-glass seal arrangement along the inner wall surface. A second amalgam is disposed at the bottom portion of the lamp envelope in the region where the envelope cavity begins. Although this approach provides for proper control of mercury vapor pressure, the manufacturing steps necessary to implement such an arrangement are considerable and are in fact subject to breakage as a result of the glass-to-metal seal arrangement. Furthermore, any glass-to-metal seal is inherently a life limiting characteristic, defeating the purpose of an electrodeless lamp, i.e., to extend lamp life efficaciously.

Accordingly, it is desirable to provide an amalgam support arrangement that is easily implemented in an automated manufacturing process and without requiring a glass-to-metal sealing procedure.

SUMMARY OF THE INVENTION

Based on the principles of the present invention, there is provided an electrodeless fluorescent lamp having a lamp envelope sealed in a vacuum type manner and filled with mercury and a rare gas which is ionizable to a discharge state upon introduction of an RF signal. The RF signal is generated by a ballast arrangement disposed in the lamp base and is effective for generating an initial electric field sufficient to initiate the discharge and a magnetic field sufficient to maintain steady-state operation of the discharge. An amalgam, which is the source of mercury, is disposed within the lamp envelope to control mercury vapor pressure and is mechanically supported by an amalgam support arrangement in a manner non-invasive to the lamp envelope.

The amalgam support arrangement comprises a support member, one end of which is configured for friction-fitting within the portion of the exhaust tube that opens into the lamp envelope, i.e., the exhaust tube opening. Exemplary configurations for this end of the support member include a U-shape, spiral, zig-zag, or tubular configuration.

The amalgam support arrangement supports one or more amalgams in a "flag" configuration. The flag may be configured as, for example, a wire mesh or a spiral-shaped wire. In one embodiment, an amalgam support arrangement for an electrodeless fluorescent lamp is configured to jointly optimize positions of a starting amalgam and a running amalgam in order to optimize mercury vapor pressure in the lamp during both starting and steady-state operation, thus rapidly achieving and maintaining high light output, while avoiding any significant reduction in light output between starting and running operation.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
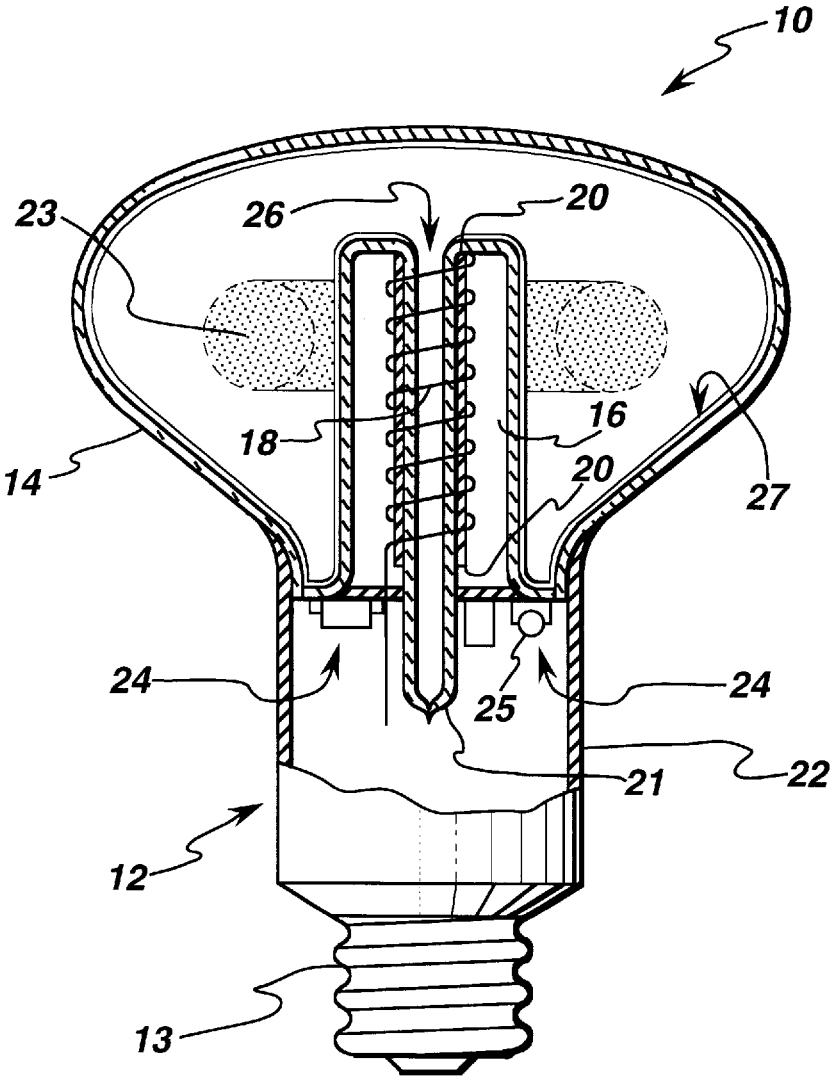
fig. 1 PRIOR ART
FIG. 1 illustrates, in partial cross section, a typical electrodeless SEF fluorescent lamp.

As illustrated in FIG. 1, an electrodeless fluorescent discharge lamp 10 that can provide the advantages of long life and efficiency over standard incandescent lamps, or even an electroded compact fluorescent lamp, includes a base portion 12 having a threaded base 13 suitable for installation in a conventional light socket as a replacement to these known sources of light. A lamp envelope 14 is formed in the shape of a conventional reflector incandescent light bulb on its external surface or in the form of a conventional A-line lamp and includes a re-entrant cavity 16 formed along the central axis of the lamp envelope 14. It is contemplated that the outer surface of the lamp envelope 14 can be shaped differently as well and still practice the advantages of the present invention; for instance, the lamp envelope 14 can also be shaped in the form of a globe lamp. The re-entrant cavity 16 is sized so as to allow a close fitting relationship between the lamp envelope 14 and an excitation coil 18 which is wound around a core 20 of insulating or magnetic material and inserted within the re-entrant cavity 16 so as to allow for the coupling of RF energy to the gas fill disposed within the lamp envelope 14. Although coil 18 is shown schematically as being wound about the core 20, this is by way of illustration only; that is, the coil may be alternatively wound directly about the exhaust tube which is used for evacuating and filling the lamp, or may be free standing, as desired. A suitable fill, for example, comprises a mixture of a rare gas (e.g., krypton and/or argon) and mercury vapor and/or cadmium vapor.

A ballast circuit 24 is disposed within the housing portion 22 formed adjacent to the threaded base 13. The ballast circuit 24 is effective for developing an operating signal from conventional line power which, when fed through a resonant circuit comprised of a capacitor 25 and the excitation coil 18, results in the RF signal needed to initiate and maintain a gas discharge 23 of the electrodeless fluorescent lamp 10. The inner surface of the lamp envelope 14 is coated with appropriate fluorescent materials 21, such fluorescent materials being selected from a group of known appropriate materials and applied in a known manner.

Upon final assembly of the electrodeless fluorescent discharge lamp 10 shown in FIG. 1, the lamp envelope 14 fits over the excitation coil 18 in a closely adjacent manner such that, upon energization of the ballast circuit, an RF signal generated thereby is inductively coupled to the fill disposed within the lamp envelope 14. The inductive coupling of the RF signal results in the ionization of the molecules which comprise the fill by the generation of an electric field which initiates the ionization, such ionization then being maintained by a magnetic field also produced by the RF signal. The resulting gas discharge 23 is then used to produce visible light by the known principles of fluorescent lighting.

In accordance with the present invention, an electrodeless fluorescent discharge lamp includes an amalgam support member having at least one amalgam disposed thereon, the amalgam support member being fixedly secured within an exhaust tube opening 26 formed along the central axis of the re-entrant cavity 16. The amalgam is disposed on a "flag" by impregnating or electroplating the flag with a metal or alloy capable of forming an amalgam with mercury. Exemplary configurations for an amalgam flag according to the present invention comprise a wire mesh or screen and a spiral-shaped wire.

Exemplary amalgams comprise a combination of bismuth and indium. Another exemplary amalgam comprises pure indium. Still another exemplary amalgam comprises a combination of lead, bismuth and tin, such as described in commonly assigned U.S. Pat. No. 4,262,231, cited hereinabove. And yet another amalgam may comprise a combination of zinc, indium and tin. Each amalgam has its own optimum range of operating temperatures. Hence, optimum positions for a particular amalgam in the lamp depend on the optimum range of operating temperatures for the particular amalgam.

Figure 2:
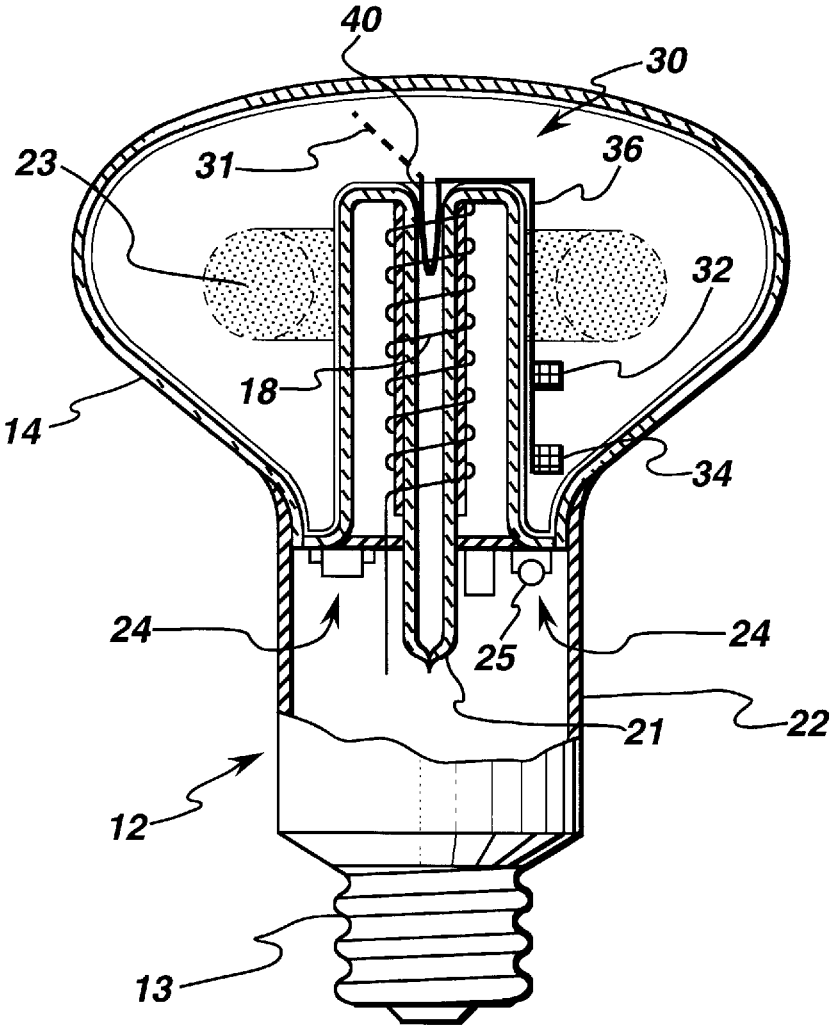
FIG. 2 illustrates an electrodeless SEF lamp including an amalgam support arrangement according to one embodiment of the present invention.

FIG. 2 illustrates an electrodeless fluorescent lamp according to the present invention comprising an amalgam support member 30 for supporting two amalgam flags, i.e., a starting amalgam flag 32 and a running amalgam flag 34. By way of illustration, the amalgam flags 32 and 34 are each shown as comprising a wire mesh or screen configuration. Use of two amalgam flags is also by way of illustration only, since the principles of the present invention are applicable to electrodeless fluorescent lamps having one or more amalgam flags. Each amalgam-supporting flag may be comprised of, for example, stainless steel or nickel. Each amalgam flag includes a stem portion 36 made of a metal which can be bent so as to allow for adjustment in position of the amalgam. The amalgam flags may be welded to the stem portion 36; or, alternatively, the amalgam flags may be folded about the stem portion 36 and crimped thereto. The position of the starting amalgam 32 is optimized for achieving high light output quickly; and the position of the running amalgam 34 is optimized to maintain the high light output during steady-state operation without any significant reduction in light output between starting and running conditions. The optimized positions for the starting and running amalgam flags depend on the particular type(s) of amalgam used.

In the embodiment of FIG. 2, the stem portion 36 of the amalgam support 30 has a substantially U-shaped end 40 that is friction-fitted within the exhaust tube 21. During lamp manufacture, support 30 may be inserted using an appropriate tool; alternatively, support 30 may additionally include an extension 31 (shown in phantom) which is used to insert support 30 and is then clipped off.

Figure 3:
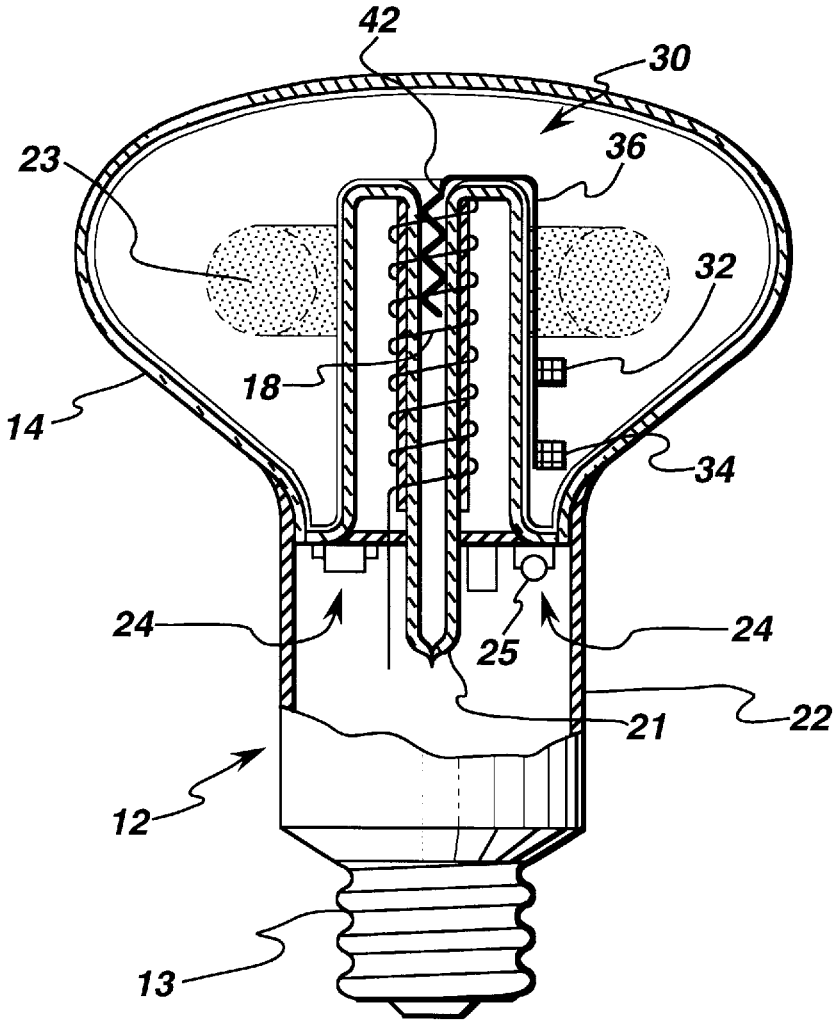
FIG. 3 illustrates an electrodeless SEF lamp including an amalgam support arrangement according to another embodiment of the present invention.

FIG. 3 illustrates another embodiment of the present invention wherein the stem portion 36 of the amalgam support 30 has a substantially spiral-shaped end 42 that is friction-fitted within the exhaust tube 21.

Figure 4:
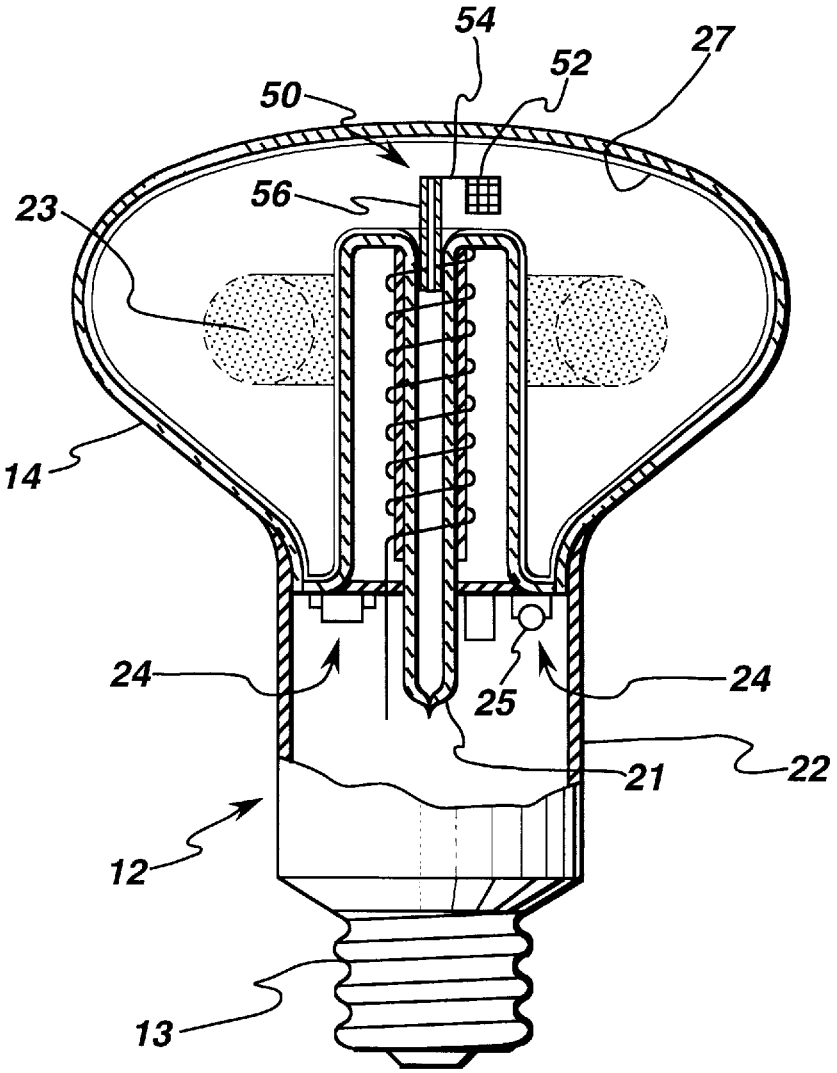
FIG. 4 illustrates an electrodeless SEF lamp including an amalgam support arrangement according to another embodiment of the present invention.

FIG. 4 illustrates yet another embodiment of the present invention wherein an amalgam support member 50 comprises at least one amalgam flag 52 with a stem or wire portion 54 attached to a cylindrical or tubular shaped member 56 that is friction-fitted within the exhaust tube 21. The material of the stem portion 54 may be metallic so as to allow for a simple securing operation that secures the amalgam flag to the tubular member 56, such as, for example, by a welding or brazing operation. Of course, other suitable materials for the stem portion and tubular member, such as glass or ceramic, for example, can be utilized that would lend themselves to a simple securing operation therebetween.

Figure 5:
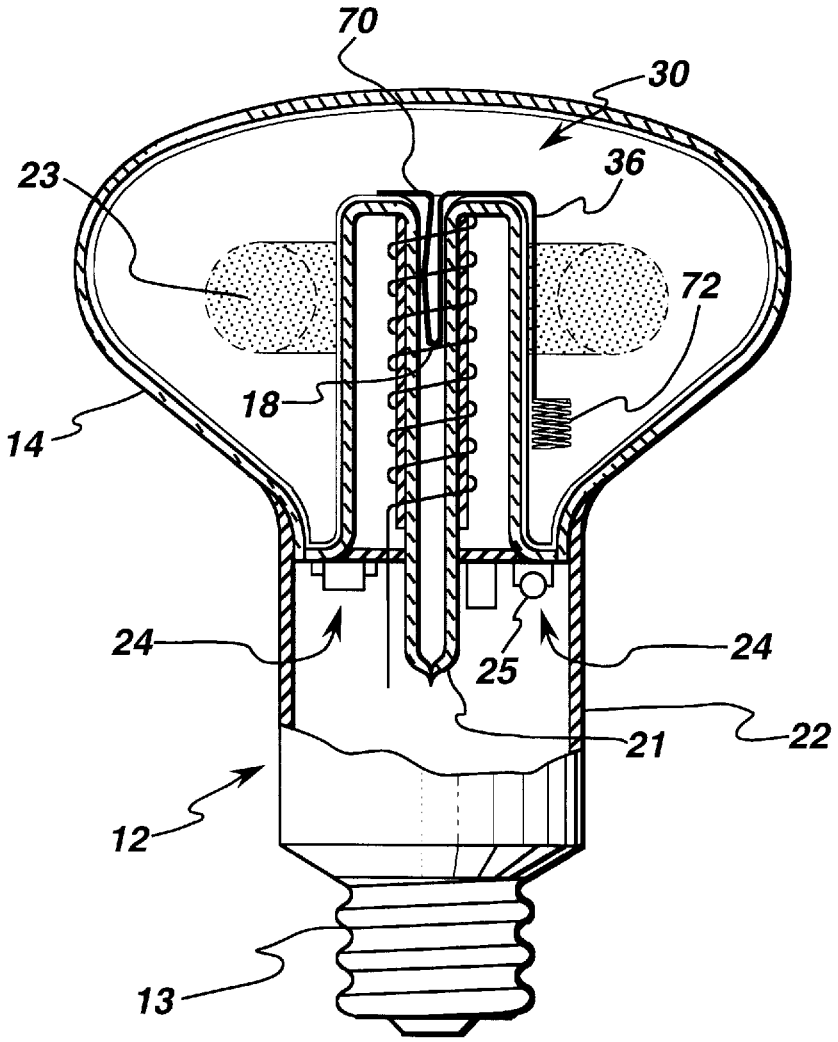
FIG. 5 illustrates an electrodeless SEF lamp including an amalgam support arrangement according to another embodiment of the present invention.

FIG. 5 illustrates still another embodiment of the present invention wherein an amalgam support member comprises at least one amalgam flag in the form of a spiral-shaped wire 72 with a stem portion having a substantially U-shaped end 70. The amalgam-forming metal or alloy can be disposed on such a spiral-shaped flag by electroplating or by dipping the spiral wire into the amalgam-forming metal or alloy. In one embodiment, spiral-shaped wire 72 is part of the same wire structure (i.e., is integral with) the stem portion 36 and the end 70 thereof. However, in an alternative embodiment, spiral-shaped wire 72 is formed separately from the rest of the amalgam support 30 and crimped thereto. Forming the spiral-shaped wire 72 separately has the following advantages: it is easier to manufacture the stem portion and the spiral-shaped wire separately; the coil can be electroplated separately before attaching to the stem portion which is made of, for example, stainless steel; the spiral-shaped wire can be made from a different material from the stem portion which may be more suitable for electroplating than the material of the stem portion (e.g., nickel, iron, copper).

During lamp processing, an amalgam support member according to the present invention is fitted within the exhaust tube. The re-entrant cavity is then sealed to the outer envelope. Then, the exhaust tube is coupled to a pumping line, and the bulb is evacuated. A controlled amount of mercury is added to the lamp using a precise mercury dosing method to form the amalgam(s), the precise amount of mercury determining the performance of the amalgam(s). According to one mercury dosing method, mercury is added in solid form, for example as a mercury-zinc pellet such as of a type provided by APL Engineered Materials, Inc. When heated, the mercury liquefies and separates from the zinc to form the amalgam. According to another mercury dosing method, as described in U.S. Pat. No. 5,213,537 of V. D. Roberts et al., issued May 25, 1993, which is incorporated by reference herein, the lamp is dosed with mercury in the vapor phase. Finally, the bulb is filled through the pumping line and the exhaust tube, and the exhaust tube is sealed.

In accordance with the principles of the present invention, the configuration of the end of the amalgam support member, such as those illustrated in FIGS. 2–4, can be modified and still achieve the result of providing a tight and secure fit to the contour of the inner diameter of the exhaust tube, any such modified configurations being within the scope of the present invention. Advantageously, in any of the alternative configurations of the present invention, the procedure for locating the amalgam within the lamp envelope is simpler and capable of longer life than would be in an arrangement that utilizes a glass-to-metal seal for securing the amalgam material within the lamp envelope.

As an additional advantage, the amalgam support arrangements according to the present invention do not interfere with lamp processing or require any modification of the re-entrant cavity.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. An electrodeless discharge lamp, comprising:

a light-transmissive envelope containing an ionizable, gaseous fill for sustaining an arc discharge when subjected to a radio frequency magnetic field and for emitting ultraviolet radiation as a result thereof, said envelope having an interior phosphor coating for emitting visible radiation when excited by said ultraviolet radiation, said envelope having a re-entrant cavity therein;

an excitation coil contained within said re-entrant cavity for providing said radio frequency magnetic field when excited by a radio frequency power supply;

an exhaust tube extending through said re-entrant cavity;

at least one amalgam disposed on a first portion of a support member in a position within the interior of said envelope that is optimized to maximize light output from the lamp, said support member having a second portion thereof secured within said exhaust tube in a manner so as to avoid a glass-to-metal seal condition, said support member supporting said amalgam within the interior of said envelope such that neither the amalgam nor the support member contacts or degrades the envelope or the phosphor coating and further do not interfere with light output from the lamp.

2. The lamp of claim 1 wherein said support member comprises a flag member attached to a stem portion, said amalgam being disposed on said flag member.

3. The lamp of claim 2 wherein said stem portion is configured for friction-fitting within said exhaust tube.

4. The lamp of claim 3 wherein said stem portion comprises a metal wire member.

5. The lamp of claim 4 wherein said metal wire member is substantially U-shaped.

6. The lamp of claim 2 wherein said flag member comprises a wire mesh.

7. The lamp of claim 6 wherein said wire mesh is crimped about said stem portion.

8. The lamp of claim 2 wherein said flag member comprises a spiral-shaped wire.

9. The lamp of claim 8 wherein said spiral-shaped wire is crimped to said stem portion.

10. The lamp of claim 3 wherein said stem portion comprises a tubular member.

11. The lamp of claim 4 wherein said metal wire member is substantially spiral-shaped.

12. The lamp of claim 1 comprising a starting amalgam and a running amalgam, said support member supporting said starting amalgam and said running amalgam in optimized starting and running locations, respectively, to achieve and maintain a predetermined light output, while avoiding any substantial reduction therein between starting and running the lamp.

13. The lamp of claim 12 wherein said support member comprises a starting flag member and a running flag member attached to a stem portion, said starting amalgam being disposed on said starting flag member and said running amalgam being disposed on said running amalgam flag member.

14. The lamp of claim 13 wherein said support member is friction-fitted within said exhaust tube.

* * * * *